US005800000A

United States Patent [19]

Shockley

[11] Patent Number: 5,800,000

[45] Date of Patent: Sep. 1, 1998

[54] LOAD ADJUSTING DEVICE FOR A HOIST

[76] Inventor: James D. Shockley, 1735 E. Saluda Lake Rd., Greenville, S.C. 29611

[21] Appl. No.: 772,971

[22] Filed: Dec. 23, 1996

[51] Int. Cl.[6] ..... B66C 1/10; B66C 13/08

[52] U.S. Cl. ..... 294/81.3; 294/67.5; 294/81.4

[58] Field of Search ..... 294/67.1, 67.21, 294/67.3, 67.5, 81.1, 81.2, 81.3, 81.4, 81.5, 81.56, 82.12, 86.41

[56] References Cited

U.S. PATENT DOCUMENTS

| | | | |
|---|---|---|---|
| 1,535,022 | 4/1925 | Jenkins | 294/81.3 |
| 2,063,040 | 12/1936 | Jolly | 294/81.4 X |
| 2,412,488 | 12/1946 | Austin | 294/81.3 |
| 2,696,317 | 12/1954 | Toffolon | 294/81.56 X |
| 3,995,903 | 12/1976 | Ernst | 294/81.3 |
| 4,597,602 | 7/1986 | McGriff | 294/81.3 |
| 4,626,012 | 12/1986 | Weldele | 294/81.3 |
| 4,936,616 | 6/1990 | Williams | 294/81.3 |

FOREIGN PATENT DOCUMENTS

| | | | |
|---|---|---|---|
| 2529068 | 1/1977 | Germany | 294/81.3 |
| 3192093 | 8/1991 | Japan | 294/81.4 |
| 1625809 | 2/1991 | U.S.S.R. | 294/81.4 |
| 624672 | 6/1949 | United Kingdom | 294/82.12 |
| 736679 | 9/1955 | United Kingdom | 294/81.4 |

OTHER PUBLICATIONS

Northern Hydraulics Catalog, Inc., "Catalog #113", 1996, p. 100, Mighty Shop Hoist Lifts Diesel Engines.

Assembly Inctructions for "Engine Lift Equalizer", Excalibur Tool and Equipment Co., Greenville, South Carolina, no date.

*Primary Examiner*—Johnny D. Cherry

*Attorney, Agent, or Firm*—Cort Flint

[57] ABSTRACT

The present invention provides a load adjusting device for use with a hoisting unit. The device includes a load spreader or spreader bar supported from a single lift point hoist by a load leveling assembly that provides an ability to adjust the location of the single lift point with respect to the spreader bar. A roller support device allows the location of the single lift point to be accurately positioned along the spreader bar. Changing this position provides an attitude adjustment of the load about a horizontal pitch axis perpendicular to the spreader bar. At both ends of the spreader bar end lifting elements support the load from a plurality of transfer linkages associated with the load. The end lifting elements have load supports and adjustors that allow the load to be biaxially adjusted about both the horizontal pitch axis, as well as a horizontal roll axis parallel to the spreader bar.

16 Claims, 6 Drawing Sheets

LOAD ADJUSTING DEVICE FOR A HOIST

BACKGROUND OF THE INVENTION

This invention relates to materials handling, and more particularly to a device for supporting the load of a solid article while being lifted and positioned by a hoisting unit.

The task of lifting heavy objects is generally associated with the use of equipment designed to make the job easier and safer. This task is further complicated by the frequent need to control the position of the object as a load having a preferred orientated for proper handling, installation and use. The proper orientation may be driven by a requirement to install or attach the load in association with another structure to receive the load and\or to work in combination with the load.

Commonly used equipment for lifting includes hoisting units having a single lifting member or hook which extends from the unit by a chain or a cable to support the load. The hoisting unit can support the load and move the load vertically. For example, a crane for large loads of a construction site and a shop hoist for an vehicle repair shop are used as vertical lift hoisting units. The entire hoisting unit can be used to transport loads horizontally. The problem with the single lift point hoisting unit is that the attitude of the load cannot be controlled in addition to its vertical lift position and horizontal location.

A commonly used lifting device for partially controlling the attitude of a load is a simple beam or cross-member extending generally normal to the chain or cable supporting the lifting device. The beam lifting device allows the load to be supported from more than one lifting attachment locations or connections of the load. Linkages are attached to the beam along its length for connecting with the load attachment locations. However, little or no control of the pitch or roll attitude of the load is provided with the beam device. Pitch is defined as a rotation about a horizontal axis perpendicular to the plane of the beam and cable. In addition, the pitch attitude of the load is very sensitive to the placement of linkages extending from the beam to the load. A typical lifting beam device is illustrated with a shop hoist on page 100 of Northern Hydraulics Catalog, Inc, catalog #113. Beam hoist equipment is available from retail suppliers of materials handling equipment. Such equipment has lifting locations at each end of a beam, and a lifting handle assembly slides along the beam. The attitude of the load has only a single pitch adjustment for balancing the load.

The need exists to have improved control on the attitude of a load being supported by a single point hoisting unit. A special need exists for controlling the roll attitude in addition to the pitch attitude of a load being lifted and biaxially rotated to be aligned with an associated structure. A further need exists to provide better control of the pitch attitude of the load by providing a fine adjustment in a mechanism providing a pitch attitude adjustment.

Accordingly, an object of the present invention is to provide an load adjusting device which can biaxially adjust the attitude of the load supported by a hoisting device.

Another object of the present invention is to provide a fine adjustment for controlling the pitch attitude of a load carried by a hoisting unit using a lifting beam to support the load from a plurality of load lifting elements connected by load transfer linkages with the load.

Yet another object of the present invention is to biaxially align a load supported by a hoisting unit with an associated structure to which the load is to be mated. Alternately, the load may be biaxially aligned for placing the load at a predetermined orientation for stacking units or working on components of the load.

SUMMARY OF THE INVENTION

The above objectives are accomplished according to the present invention by providing a load adjusting device for use with a hoisting unit. The device includes a spreader bar or load spreader supported from a single lift point by a load leveling assembly that provides an ability to adjust the location of the single lift point along the length of the load spreader. A roller support device allows the location of the single lift point to be accurately positioned with respect to the load spreader. Changing this position provides an attitude control of the load about a horizontal pitch axis. At remote locations on the load spreader, end lifting elements associated with alignment adjustment assemblies support the load from a plurality of load transfer linkages attached to the load. The end lifting elements have load supports and adjustors that allow the load to be biaxially adjusted; as defined by rotating the load about the pitch axis as well as a horizontal roll axis.

The objects are generally accomplished by a load adjusting system, for use with a hoisting unit, for rotatably adjusting a load being suspended from the hoisting unit. The system comprises a load leveling assembly for supporting and adjusting the load in a pitch rotational direction with respect to the hoisting unit. The system further comprises at least one alignment adjustment assembly carried by the leveling assembly to further adjust the load in the pitch rotational direction and in a roll rotational direction with respect to the hoisting unit. Load transfer linkages are for connecting the alignment adjustment assembly with the load to rotate the load for mating the load with an interface of an associated structure.

In another embodiment of the invention, the above objects are accomplished by a load adjusting device for use with a single lift point hoisting unit for handling and biaxially rotating a load for aligning the load with an associated structure. The device comprises a load leveling assembly having a load lifting device for supporting the load from the hoisting unit. A load spreader bar included in the leveling assembly is for adjustably supporting the load near the end of the spreader bar. An alignment adjustment assembly carried near each end of the spreader bar has end lifting elements for supporting the load from a plurality of transfer linkages associated with the load. A first actuator is for adjusting the load leveling assembly for controllably rotating the load with respect to a horizontal pitch axis perpendicular to the spreader bar. The end lifting elements comprise second actuators for further adjusting the load about the pitch axis and for controllably rotating the load about a horizontal roll axis parallel to the spreader bar, so that the load is aligned with the associated structure.

The above objects are also realized by a method for supporting a load from a hoisting unit with a single hoisting member to biaxially control a rotational attitude of the load for mating the load with an associated structure. The method includes a first step of providing a load leveling assembly which attaches to the hoisting member for adjusting a pitch attitude of the load. A second step includes providing an alignment adjustment assembly carried by the load leveling assembly for further adjusting the pitch attitude and for adjusting a roll attitude of the load. In a third step the method includes attaching the load to the alignment adjustment assembly for lifting and supporting the load. A fourth step includes hoisting the load by activating the hoisting unit for transporting the load. A fifth step includes adjusting the load leveling assembly so that the load rotates about a horizontal pitch axis. A fifth step includes adjusting the alignment adjusting assemblies so that the load further rotates about the pitch axis and the load rotates about a horizontal roll axis normal to the pitch axis. In a final step the method includes mating the load with the associated structure.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail. The general field of this invention involves lifting and supporting a physical load and partially controlling its orientation. The device of this invention is used with any single lift point hoisting unit where a load is being lifted and rotated to a desired orientation. For example, the illustrations used herein are those of a shop hoist supporting a load, being a vehicle engine. The vehicle engine is supported such that it can be biaxially aligned with respect to a horizontal pitch axis and a horizontal roll axis for mating with other vehicle components.

Figure 1:
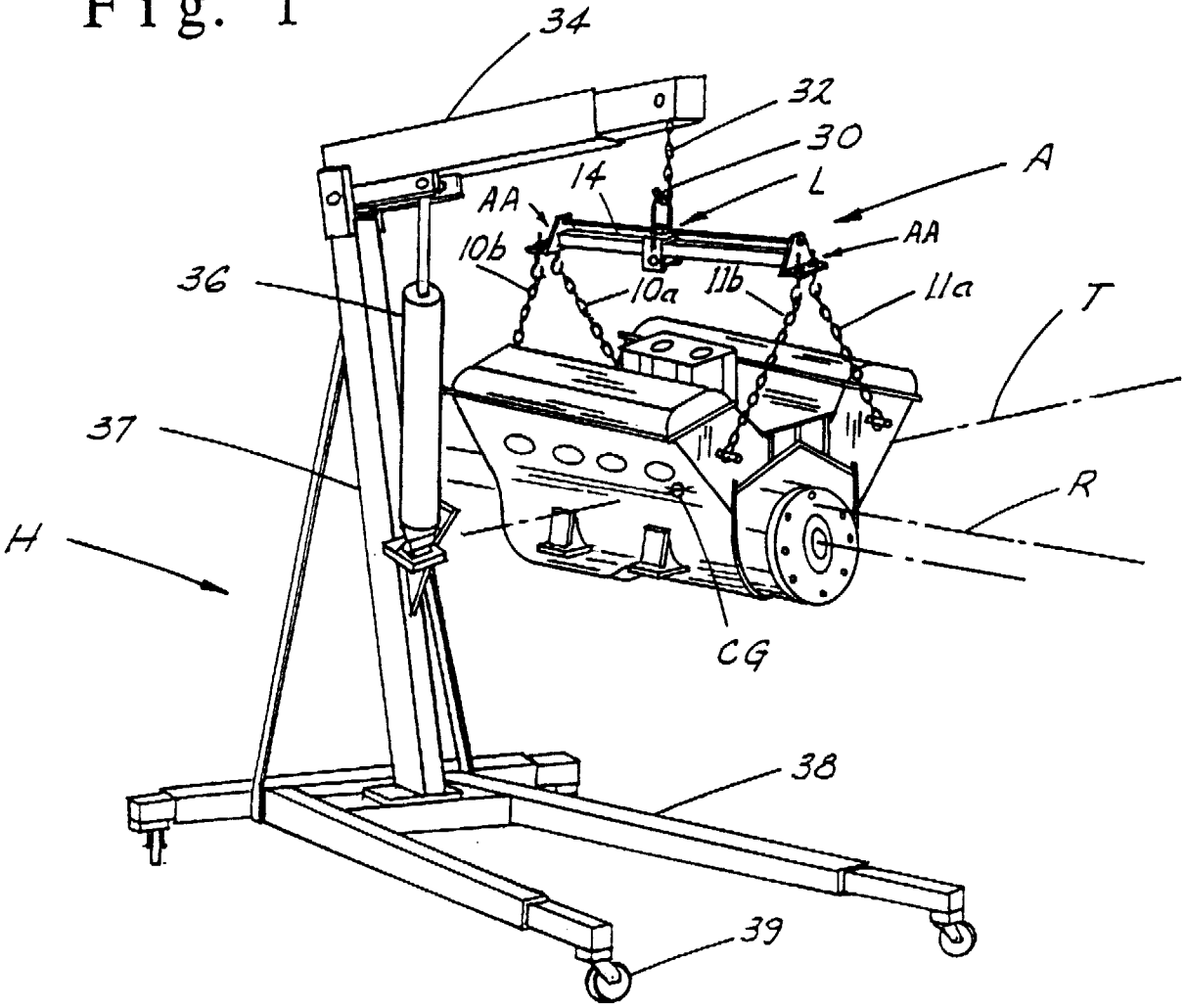
FIG. 1 is a perspective view of a hoisting unit supporting a load from a single hoisting member so that the load can be biaxially rotated using a load adjustment device according to the invention.

A load E being supported by a hoisting unit is illustrated in FIG. 1. The hoisting unit H in this case is a shop hoist having a hoisting member or hook 30 attached to a hoisting chain 32 which is supported by a hoisting arm 34. The hoisting arm is rotatably attached to a hoist column 37 and is lifted by a hydraulic hoisting cylinder 36 for generally moving the load vertically. The load can be easily rotated by hand about a vertical axis collinear with the hoisting chain. A support platform 38 is on caster wheels 39 which allows the load to be positioned horizontally by moving the hoist. Other types of hoisting units can also be used within the scope of this invention.

A center of gravity CG locates the effective position of the load E under the hoisting member 30 as it hangs from the hoisting unit H, as illustrated in FIG. 1. A load adjusting device A of this invention divides the single point load support by the hoisting member to transfer linkages 10*a* and 10*b* at one end of the device and transfer linkages 11*a* and 11*b* at the other end of the device using a load spreader. In reverse, the load spreader can be any structure that allows a weight of the load carried by a plurality of connectors or linkages that are essentially combined by the load spreader into a single point load supported by the hoisting unit. The load transfer linkages can be connected to the load by a plurality of connectors associated with the load. Connectors can be a standard fastener as illustrated in FIG. 1 or a separate component provided with the load for lifting the load. Alternately, linkages can be affixed by any means that allows the weight of the load to be transferred to the linkages without slippage between the load and the linkages. For example, a strap can be placed around the load such that the ends of the strap form linkages that can have different loads without the strap having slippage.

Figure 2:
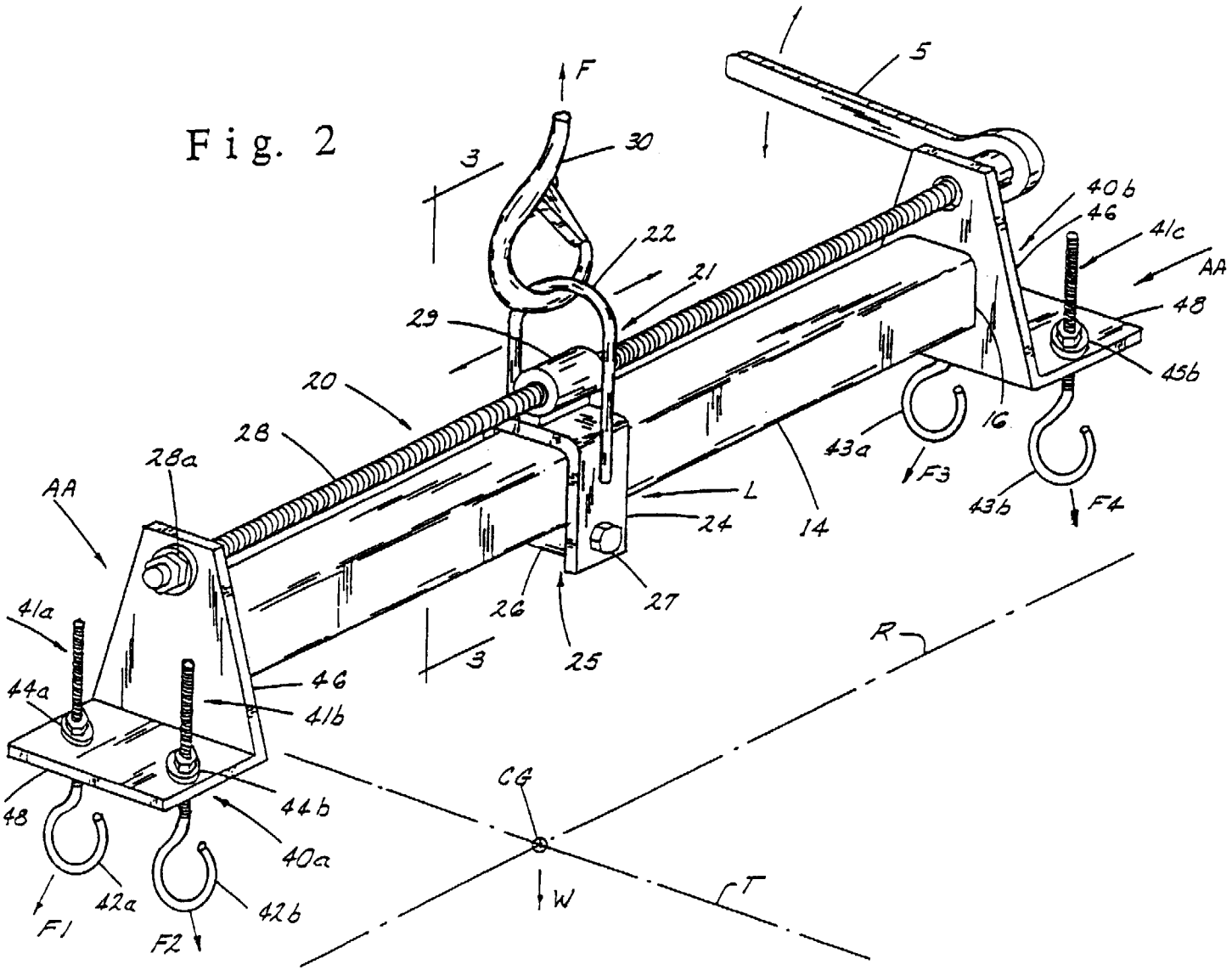
FIG. 2 is a perspective view of the load adjustment device of the invention showing a load leveling assembly being adjusted along a spreader bar for adjusting the load carried by respective ends of the spreader bar.

A load leveling assembly L of the load adjusting device A allows the load E to be generally balanced and adjusted about a pitch axis T, as illustrated in FIGS. 1 and 2. This pitch axis can be any horizontal axis perpendicular to the load spreader, being a spreader bar 14 of the load leveling assembly, and is generally taken through the center of gravity CG of the load. The load adjusting device further includes a unique and new means for adjusting the orientation of the load with respect to a horizontal roll axis R parallel to the spreader bar of the load leveling assembly L. Adjustments about the roll axis are discussed later in this description.

Figure 3:
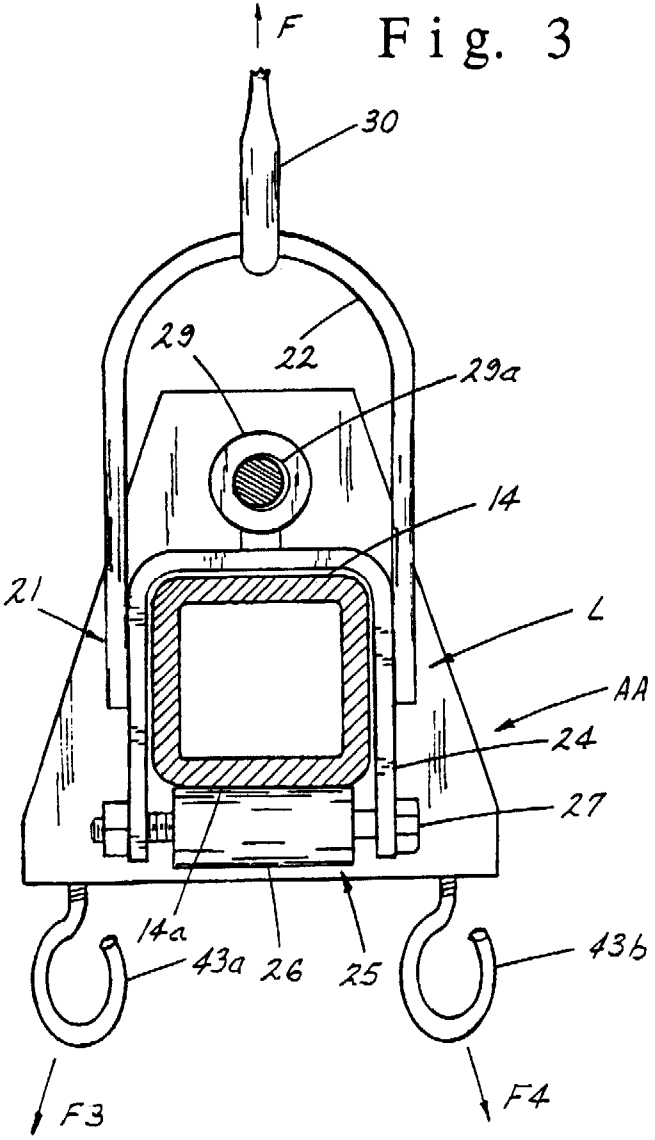
FIG. 3 is a cross-sectional view of the load adjustment device taken along line 3—3 in FIG. 2.

The load adjusting device, as illustrated in FIG. 2, includes further details of a preferred load adjusting device A providing a best mode to practice the invention. A force F on the hoisting member 30 is necessary to support the weight of the load. A load spreader or spreader bar 14 is used to allow the load to be supported from alignment adjustment assemblies AA at respective ends of the spreader bar. The preferred spreader bar is adjustably supported along its length as part of a load leveling assembly L. The force F carried by the hoisting member 30 is transferred to the spreader bar using a load transfer device 21 and a roller support device 25. The load transfer device includes a load lifting member 22 and a load transfer member 24 according to this preferred embodiment of the invention. The roller support device is shown in more detail in the cross-sectional view of FIG. 3. The roller support device includes a cylindrical roller 26 supported by the load transfer member 24 using a roller attachment 27 so that the roller contacts a bottom surface 14*a* of the spreader bar 14. The force resulting from the load is transferred to a force on the bottom of the spreader bar. The unique roller 26 of this invention allows the position of the roller support device 25 to be accurately adjusted relative to the spreader bar 14, as illustrated by the arrows adjacent the load transfer device in FIG. 2. Only slight changes in the position of the load transfer device 21 along the spreader bar 14 can produce large rotations of the load about the pitch axis T.

The position of the load transfer device 21 relative to the spreader bar 14 is controlled by a first actuator 20. The first actuator includes a threaded rod 28 extending over a length of the load spreader or spreader bar. For the preferred embodiment, the threaded rod extends between the alignment adjustment assemblies AA. The threaded rod is supported at each of its ends by extending through a respective adjustment assembly so that it is free to rotate. A rod actuator 28*a* is located at one or both ends of the threaded rod so it can be rotated by an operator's tool 5. A transfer collar 29 having a threaded bore 29*a* is affixed to the load transfer device 21 to interface with the threaded rod for moving the load transfer device along the spreader bar, as indicated by the arrows (FIG. 2). An operator rotates the threaded rod in either rotational direction for balancing the load with respect to the load leveling assembly L. In addition, the operator can rotate the rod to select a desired pitch axis T rotation of the load E with respect to the horizontal to provide a first alignment adjustment of the load. The load is rotated about the pitch axis T to obtain either a forward or a backward first rotational adjustment.

The orientation of the supported load is further controlled by the respective lengths of the transfer linkages 10*a* and 10*b* connected at one end of the load and transfer linkages 11*a* and 11*b* connected at the other end of the load, as illustrated in FIG. 1. The loads on these linkages are illustrated as forces F1–F4 in FIGS. 2, 3 and 4. The sum of the vertical components of the loads F1, F2, F3 and F4 plus the weight of the load adjusting device A is equal to the force F on the hoisting member 30. The orientation of the load is given a second adjustment by changing the lengths of the linkages to change the relative magnitude of loads F1–F4. The magnitude of the forces are changed when load supports of each alignment adjustment assembly AA provide a change in the respective lengths of the load transfer linkages. These changes are realized by a load lifting element 40*a* or 40*b* associated with a respective alignment adjustment assembly.

Figure 4:
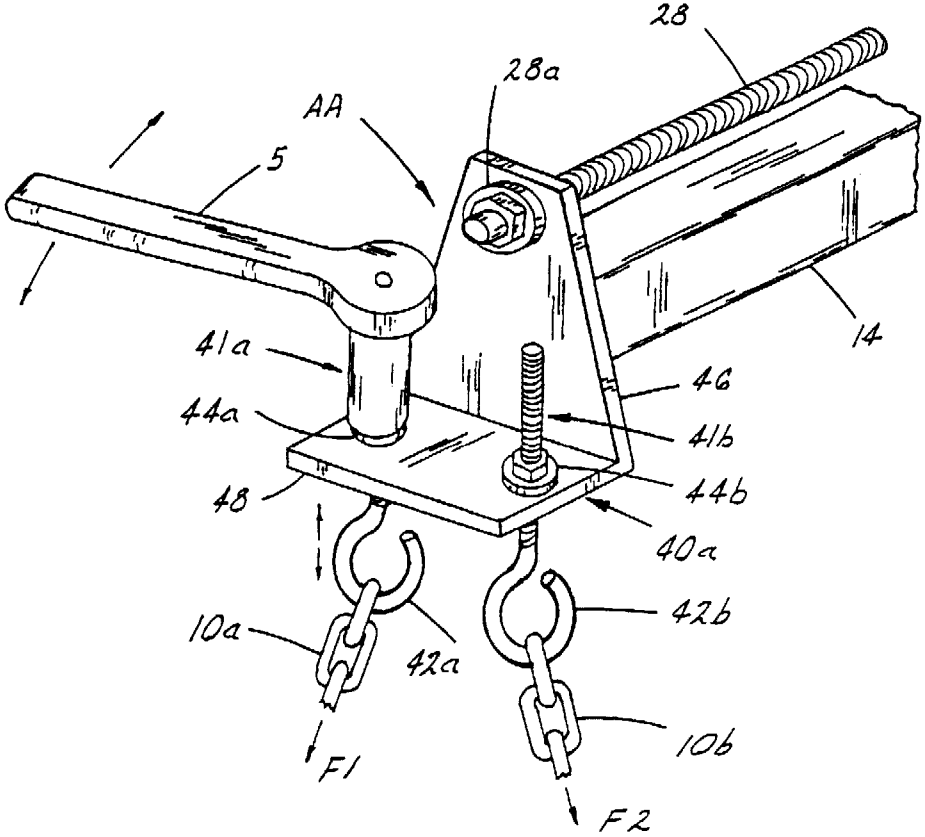
FIG. 4 is a perspective view of one end of the load adjustment device of the invention being activated and adjusted for further alignment of the load.

The load lifting elements 40*a* and 40*b* are illustrated in FIGS. 2 and 4. An outstanding leg 48 of the preferred alignment adjustment assembly AA carries the load lifting elements at each end of the spreader bar 14. The load lifting elements, comprising second actuators 41*a* and 41*b*, are adjusted to rotate the load about both the pitch axis T and the roll axis R. Each lifting element second actuator includes a load support and a load adjustor. Preferably, the load support is a threaded eye bolt and the load adjustor is a nut supported by a washer resting on the outstanding leg. An adjustment is realized by turning at least one nut with an operator's tool 5, as illustrated in FIG. 4, to move at least one load support with respect to a respective outstanding leg. The end result is achieved by generally adjusting the loads F1, F2, F3, F4 on the transfer linkages 10*a*, 10*b*, 11*a*, 11*b* by adjusting the position of at least one load support 42*a*, 42*b*, 43*a* and\or 43*b* with respect to an outstanding leg 48 using a respective load adjustor 44*a*, 44*b*, 45*a* and/or 45*b*. The orientation of the load E about the pitch axis T, as well as about a horizontal roll axis R, is achieved by selectively adjusting the load adjustors.

Other load lifting elements and load spreaders are within the scope of this invention consistent with providing at least three load supports; which are associated with three transfer linkages connected to the load. This provides the second actuator means for adjusting the attitude of the load about the pitch axis T as well as the roll axis R. That is, a minimum number of three separately lifting elements are required at remote lifting locations of the load spreader to achieve this additional roll axis adjustment unique to this invention.

Figure 5A:
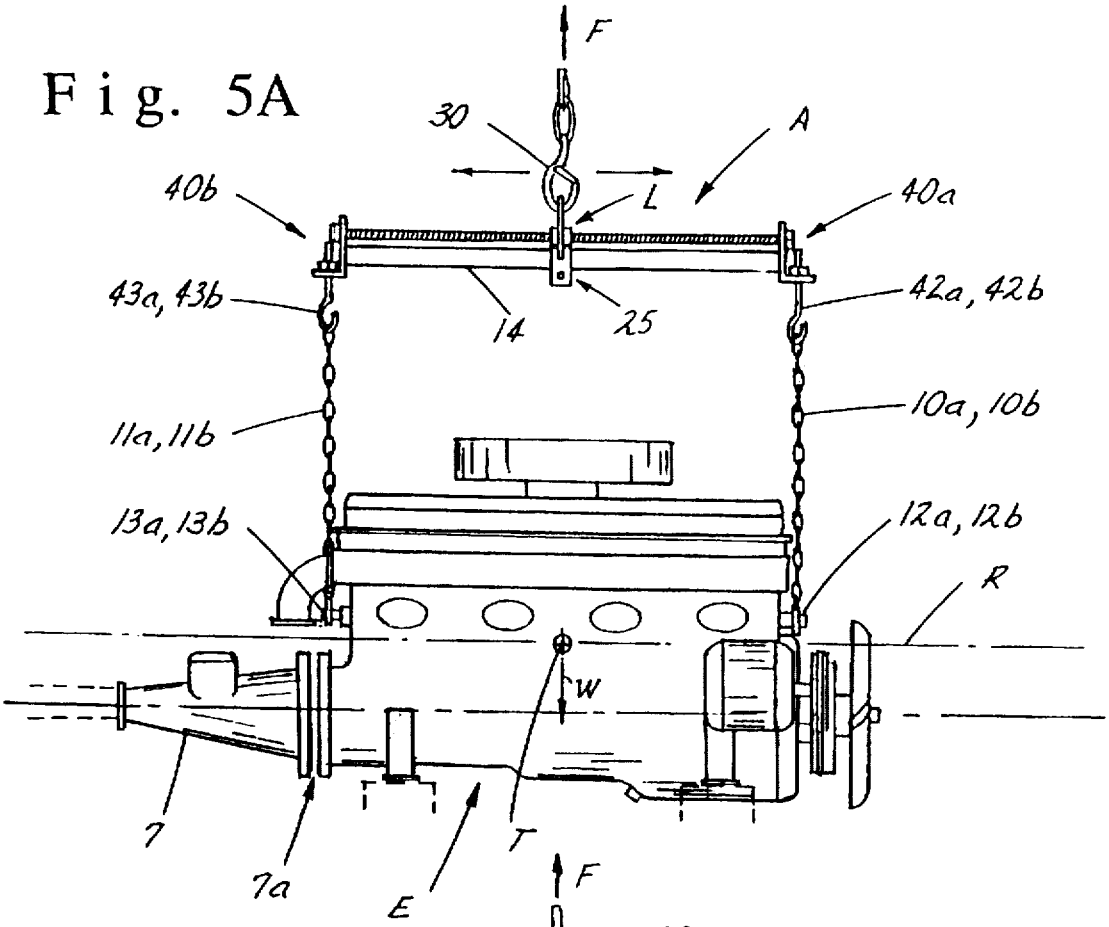
FIG. 5A is a side elevation view of the load being properly supported and balanced with respect to a pitch axis by moving a load leveling assembly along a spreader bar of the load adjustment device of the invention.
Figure 5B:
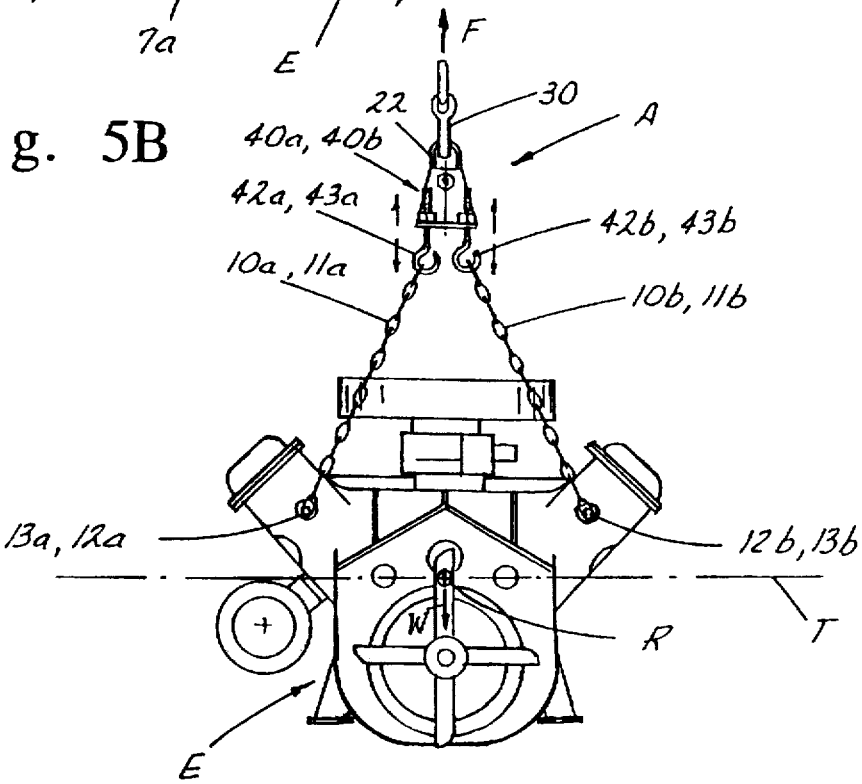
FIG. 5B is an end elevation view of the load being supported and balanced with respect to a roll axis by proper adjustment of an alignment adjusting assembly of the invention.

A load being supported and balanced according to the invention is illustrated in the elevation views of FIGS. 5A and 5B. The load adjustment device A supports the load E from a plurality of transfer linkages 10*a*, 10*b*, 11*a*, 11*b* associated with the load. A load spreader or spreader bar 14 is supported by the load roller support device 25 which transfers the weight of the load to the lifting member 30. The lifting force F is necessary to support the weight of all the components including the load E. The linkages 11*a* and 11*b* are connected to the load lifting element 40*b* and linkages 10*a* and 10*b* are connected to the load lifting element 40*a*. Load lifting elements 40*a* and 40*b* are associated with the alignment adjustment assemblies AA as previously discussed. A horizontal pitch axis T has been defined perpendicular to the spreader bar, and is preferably placed through the center of gravity CG of the load. A horizontal roll axis R has also been defined parallel to the spreader bar, and is preferably placed through the center of gravity CG of the load. Transfer linkages are preferably associated with said load by being connected to the load with connectors 12*a*, 12*b*, 13*a*, 13*b*. However, other means of fixing the linkages to the load are within the scope of this invention.

The load adjustment device A allows the load to be biaxially rotated so that its orientation or location relative to an associated structure can be controlled. For example, the load E is an engine in FIGS. 5A and 5B and the associated structure is a transmission 7. The gap 7*a* between the engine and its transmission must be closed so that they can be properly attached to one another. The alignment of the load with the associated structure is also important when these components are being separated, for example, in supporting the motor to be disconnected and removed from a vehicle.

Figure 6A:
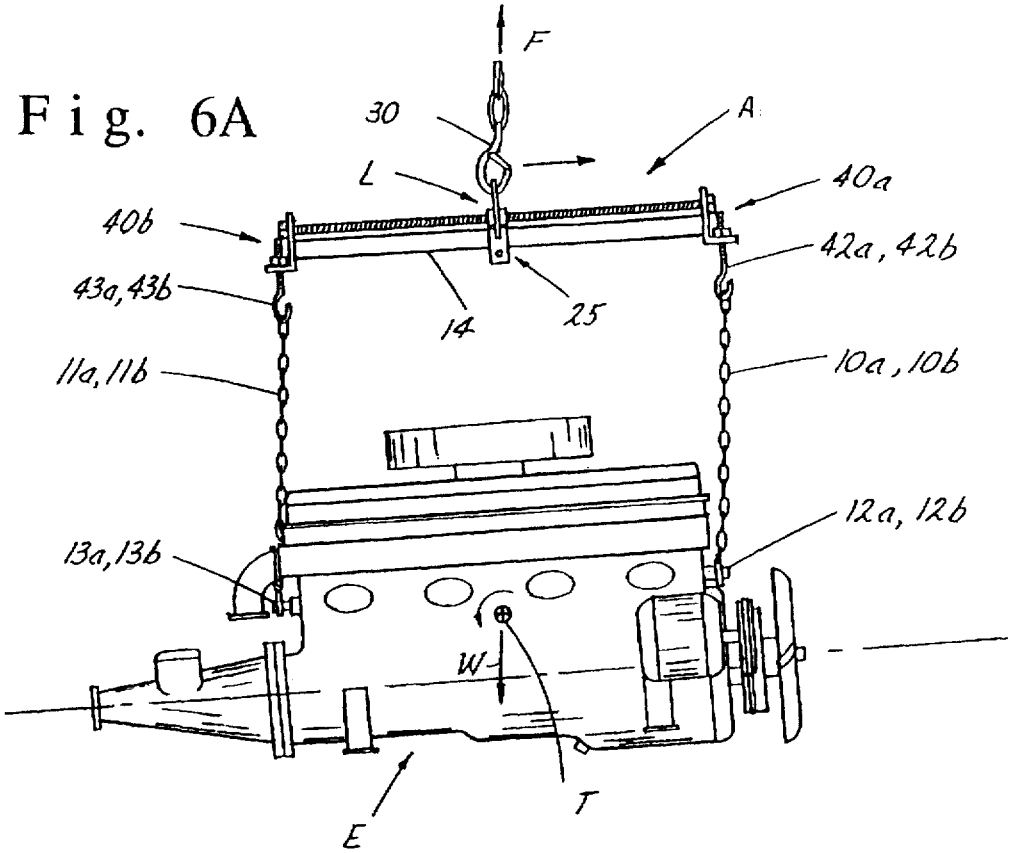
FIG. 6A is a side elevation view of the load being rotated about the pitch axis by moving the load leveling assembly.
Figure 6B:
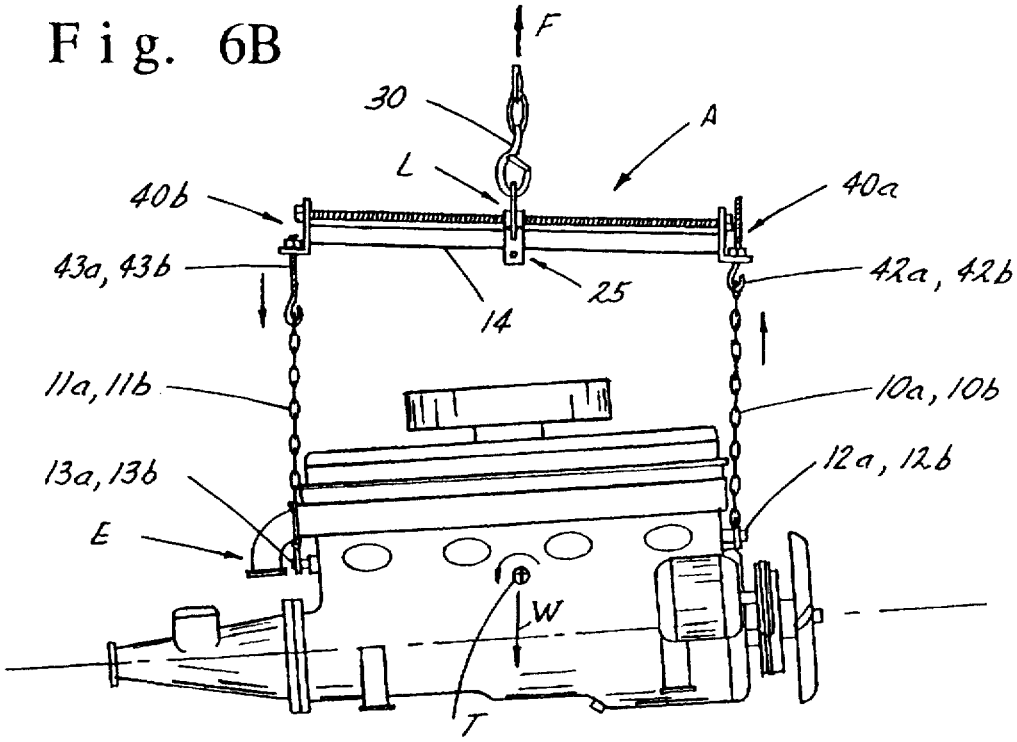
FIG. 6B is a side elevation view of the load being rotated about the pitch axis by adjusting the alignment adjustment assembly.

An adjustment of the load about the pitch axis T can be realized by the load transfer device 21 being relocated along the spreader bar 14 using the first actuator 20, as illustrated by the horizontal arrows of FIG. 5A. A typical pitch axis adjustment is illustrated in FIG. 6A. A further adjustment about the pitch axis can be realized by using the second actuators of the load lifting elements 40*a* and 40*b*. The second actuators adjust the load about the pitch axis T by moving the load supports 42*a* and 42*b* on one end of the spreader bar in a different vertical direction than the load supports 43*a* and 43*b* on the other end of the spreader bar. A typical pitch adjustment is illustrated in FIG. 6B. One important feature of this invention is that a coarse pitch axis adjustment is made by moving the load transfer device 21 along the spreader bar 14 using the first actuator and followed by a fine pitch adjustment made by adjusting the load lifting elements 40*a* and 40*b* using the second actuators.

Figure 7A:
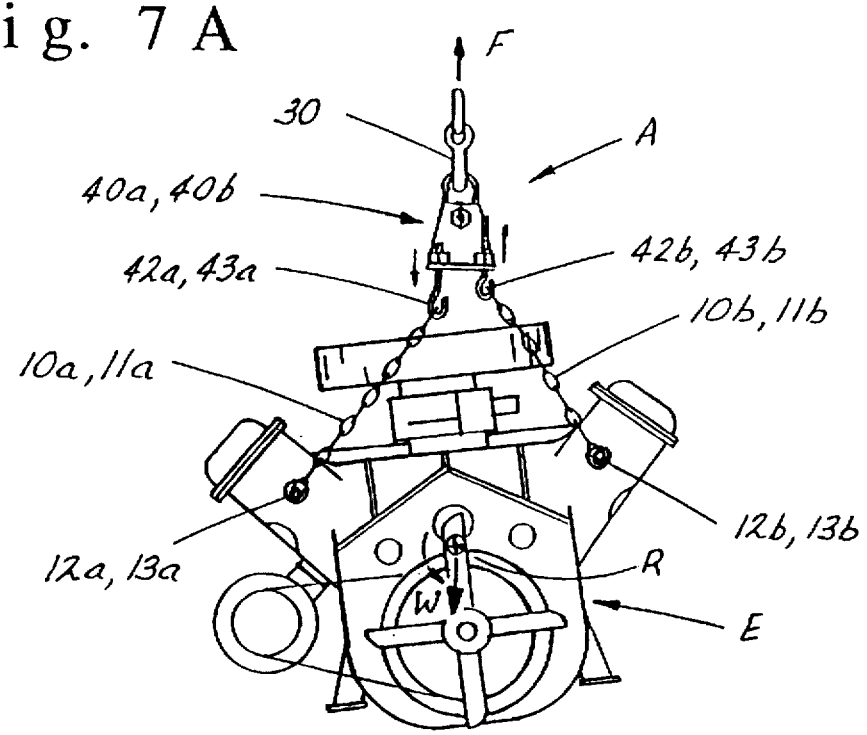
FIG. 7A is an end elevation view of the load being rotated counterclockwise about the roll axis by an adjustment of the alignment adjustment assembly.

An adjustment about the horizontal roll axis R can be realized by again using the second actuators associated with the load lifting elements 40*a* and 40*b*. The roll axis adjustment is provided by moving the load supports 42*a* and 43*a* on one lateral side of the load lifting elements in a different vertical direction than the load supports 42*b* and 43*b* on the other lateral side of the load lifting elements. A typical rotation clockwise about the roll axis R is illustrated in FIG. 7A. This clockwise rotation is realized by moving load supports 42*a* and 43*a* on the left lateral side in this view downward, as shown by the downward arrow, and moving load supports 42*b* and 43*b* on the right lateral side in this view upward, as shown by the upward arrow. This adjustment effectively lengthens linkages 10*a* and 11*a* and effectively shortens linkages 10*b* and 11*b*. The result is a clockwise rotation of the load.

Figure 7B:
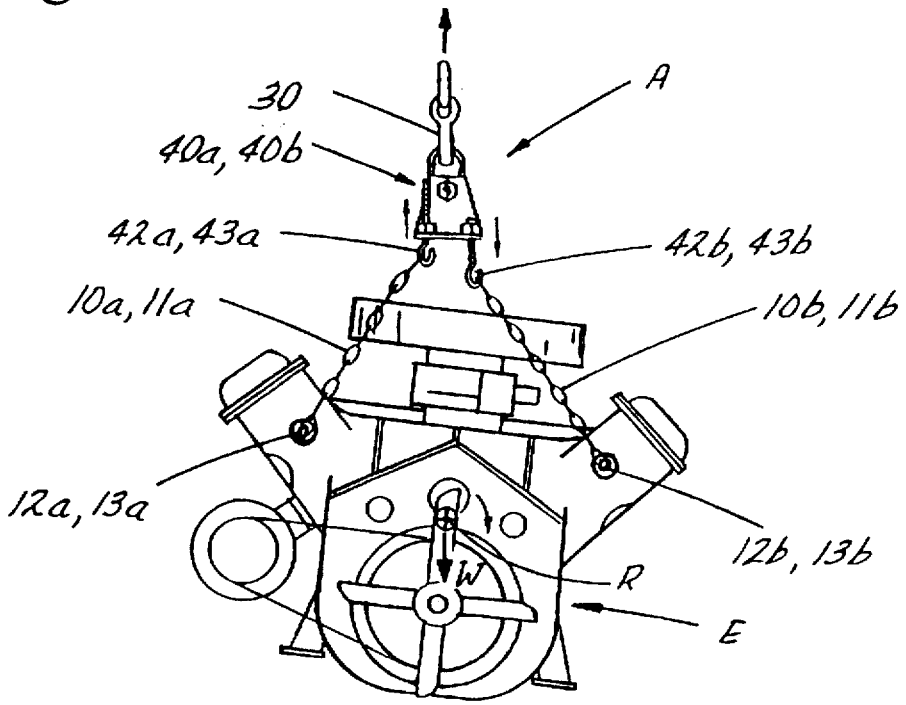
FIG. 7B is an end elevation view of the load being rotated clockwise about the roll axis by an adjustment of the alignment adjustment assembly.

A typical rotation counterclockwise about the roll axis R is illustrated in FIG. 7B. This counterclockwise rotation is realized by moving load supports 42*a* and 43*a* on the left lateral side in this view upward, as shown by the upward arrow, and moving load supports 42*b* and 43*b* on the right lateral side in this view downward, as shown by the downward arrow. This adjustment effectively makes linkages 10*a* and 11*a* shorter and effectively makes linkages 10*b* and 11*b* longer. The result is a counterclockwise rotation of the load.

While a preferred embodiment of the invention has been described using specific terms, such description is for illustrative purposes only, and it is to be understood that changes and variations may be made without departing from the spirit or scope of the following claims.

What is claimed is:

1. A load adjusting device for use with a hoisting unit for handling and biaxially aligning a load with an associated structure to which said load is to be mated, said device comprising:

a load leveling assembly for adjusting a pitch attitude of said load about a horizontal pitch axis of said load;

means for attaching said load leveling assembly to said hoisting unit for supporting said load from said hoisting unit;

a load spreader included in said load leveling assembly to support said load for adjusting said pitch attitude;

a plurality of alignment adjustment assemblies carried by said leveling assembly for connection to said load for further adjusting said pitch attitude and for adjusting a roll attitude of said load about a horizontal roll axis normal to said pitch axis;

a plurality of load lifting elements for connecting said alignment adjustment assemblies to said load;

a first actuator for adjusting said load leveling assembly to facilitate said pitch attitude adjustment; and a plurality of second actuators for activating said lifting elements to facilitate said pitch and roll attitude adjustments so that said load is in line for mating with said associated structure;

said alignment adjustment assemblies including an outstanding leg for supporting said plurality of load lifting elements and said plurality of second actuators; and, said plurality of second actuators each include:

a load support carried by said outstanding leg for connecting with a respective transfer linkage for supporting said load; and a load adjustor for adjusting the position of said load support with respect to said outstanding leg of said load lifting element of said alignment adjustment assembly.

2. The device of claim 1 wherein said load leveling assembly includes.

3. The device of claim 2 wherein said roller support device includes:

a cylindrical roller in loaded contact with a bottom surface of said load spreader for rolling along said bottom surface of said load spreader when said load transfer device is displaced relative to said load spreader by said first actuator; and a roller attachment for transferring the weight of said load from said roller to said load transfer device.

4. The device of claim 2 wherein said first actuator includes:

a threaded rod extending over a length of said load spreader and supported at each end from said load leveling assembly;

a transporting collar having an internal threaded bore that interfaces with said threaded rod, said collar affixed to said load transfer device for moving said load transfer device along said load spreader when said threaded rod is rotated; and at least one rod actuator included with said threaded rod to be accessed by an operator's tool for rotating said threaded rod to provide said pitch attitude adjustment of said load leveling assembly.

5. The device of claim 1 wherein said load support is a threaded eye bolt and said load adjustor is a nut with a washer supported by said outstanding leg.

6. The device of claim 1 wherein said load leveling assembly includes:

a load spreader for connection to said load at a plurality of lifting locations to facilitate said pitch rotational direction adjustment;

a roller support device bearing against said load spreader for supporting said load and to facilitate said pitch rotational direction adjustment of said load;

a load transfer device for transferring said load from said roller support device to said hoisting unit; and a first actuator for adjusting the location of said load relative to said load leveling assembly to provide said pitch rotational direction adjustment.

7. The device of claim 1 where infringe said outstanding leg of said alignment adjustment assemblies includes a horizontal leg extending outwardly from said load leveling assembly.

8. A load adjusting device for use with a single lift point hoisting unit for handling and biaxially rotating a load for aligning said load with an associated structure, said device comprising:

a load leveling assembly having a load lifting device for supporting said load from said hoisting unit;

a load spreader bar included in said load leveling assembly for adjustably supporting said load near both ends of said spreader bar;

an alignment adjustment assembly carried near each end of said spreader bar having a lifting element, first and second transfer linkages operatively connected to each said lifting element at laterally spaced locations for connecting each said lifting element to said load near each end of said spreader bar for supporting said load at four independent supports;

a first actuator for adjusting said load leveling assembly for controllably rotating said load with respect to a horizontal pitch axis perpendicular to said spreader bar; and a second acutator connecting each of said first and second transfer linkages to each of said lifting elements, each said second actuator including an adjustable load support;

each said second actuator including a manually actuated load adjuster associated with said adjustable load support for further adjusting said load about said pitch axis and for independently controllably rotating said load about a horizontal roll axis parallel to said spreader bar so that said load is aligned with said associated structure.

9. The device of claim 8 wherein said load leveling assembly includes:

a roller support device for adjustably supporting said spreader bar from a bottom surface of said spreader bar; and a load transfer member for transferring said load from said hoisting unit to said roller support device.

10. The device of claim 9 wherein said first actuator includes:

a threaded rod extending the length of said spreader bar and supported at each end by a respective alignment adjustment assembly;

a transfer collar affixed to said load transfer member for interfacing with said threaded rod, said collar having an internal threaded bore for moving a load leveling assembly relative to said spreader bar when said threaded rod is rotated; and at least one rod actuator included in said threaded rod to be accessed by an operator's tool for rotating said threaded rod to provide said position adjustment of said load leveling assembly relative to said spreader bar.

11. The device of claim 8 wherein said alignment adjustment assemblies each include a vertical leg for affixing said adjustment assemblies to a respective end of said spreader bar and an outstanding leg included in said end lifting element for supporting said load from said pair of second actuators.

12. The device of claim 11 wherein each one of said second actuators of said end lifting element includes:

each said load support supported by a respective outstanding leg of said end lifting element;

each said transfer linkage extending from each one of said load supports to a connector associated with said load; and each said load adjustor for adjusting the position of said each load support with respect to said outstanding leg using an operator's tool.

13. A method for supporting a load from a hoisting unit with a single hoisting member to biaxially control a rotational attitude of the load for mating with an associated structure, said method including the steps of:

providing a load leveling assembly which attaches to said hoisting member for adjusting a pitch attitude of said load;

providing alignment adjustment assemblies carried near each end of said load leveling assembly for further adjusting said pitch attitude and for adjusting a roll attitude of said load;

attaching said load to each said alignment adjustment assemblies at two independent spaced load supports by means of independent load adjusters for each load support for lifting and supporting said load about four independently adjustable load supports;

hoisting said load by activating said hoisting unit for transporting said load;

adjusting said load leveling assembly so that said load rotates about a horizontal pitch axis;

adjusting said load supports of said alignment adjusting assemblies so that said load further rotates about said pitch axis and said load rotates about a horizontal roll axis normal to said pitch axis; and mating said load with said associated structure.

14. The method of claim 13 wherein the step of adjusting said load leveling assembly includes the steps of:

providing a threaded rod and a rod actuator associated with said threaded rod for activating said load leveling assembly;

providing a transfer collar having a threaded interface with said threaded rod; and rotating said threaded rod inside said transfer collar using an operator's tool.

15. The method of claim 13 wherein the step of adjusting said alignment adjustment assembly includes the steps of:

moving said load adjustors relative to the load support by using an operator's tool for providing said movement.

16. A load adjusting device for use with a hoisting unit for handling and biaxially aligning a load with an associated structure to which said load is to be mated, said device comprising:

a load leveling assembly for adjusting a pitch attitude of said load about a horizontal pitch axis of said load;

means for attaching said load leveling assembly to said hoisting unit for supporting said load from said hoisting unit;

a load spreader included in said load leveling assembly to support said load for adjusting said pitch attitude;

a plurality of alignment adjustment assemblies carried by said leveling assembly for connection to said load for further adjusting said pitch attitude and for adjusting a roll attitude of said load about a horizontal roll axis normal to said pitch axis;

a plurality of load lifting elements for connecting said alignment adjustment assemblies to said load;

a first actuator for adjusting said load leveling assembly to facilitate said pitch attitude adjustment;

a plurality of second actuators for activating said lifting elements to facilitate said pitch and roll attitude adjustments so that said load is in line for mating with said associated structure; and said plurality of second actuators including threaded eye bolts with a nut and a washer for adjusting said load lifting elements with respect to said load spreader by positioning said nut along the length of said eye bolt.

* * * * *